US006581357B1

(12) United States Patent
Lindenberger

(10) Patent No.: US 6,581,357 B1
(45) Date of Patent: Jun. 24, 2003

(54) METHOD FOR ATTACHING A SHOULDER ELEMENT TO A BAG

(75) Inventor: Werner Lindenberger, Aesch (CH)

(73) Assignee: H. Obrist + Co. AG, Reinach (CH)

( * ) Notice: Subject to any disclaimer, the term of this patent is extended or adjusted under 35 U.S.C. 154(b) by 0 days.

(21) Appl. No.: 09/743,220

(22) PCT Filed: Jul. 2, 1999

(86) PCT No.: PCT/CH99/00290

§ 371 (c)(1),
(2), (4) Date: Apr. 12, 2001

(87) PCT Pub. No.: WO00/02779

PCT Pub. Date: Jan. 20, 2000

(30) Foreign Application Priority Data

Jul. 9, 1998 (EP) ..... 98810653

(51) Int. Cl.[7] ..... B65B 61/18; B65B 9/06

(52) U.S. Cl. ..... 53/412; 53/450; 53/133.2; 53/550; 156/69; 156/514; 493/213

(58) Field of Search ..... 53/410, 412, 450, 53/455, 133.2, 550, 562; 156/69, 514; 493/213, 929

(56) References Cited

U.S. PATENT DOCUMENTS

| | | | | | |
|---|---|---|---|---|---|
| 2,947,653 | A | * | 8/1960 | Fohr | 156/217 |
| 3,069,303 | A | * | 12/1962 | Scholle | 493/213 |
| 4,055,032 | A | | 10/1977 | Hammond | |
| 4,394,936 | A | * | 7/1983 | Shavit | 493/213 |
| 4,512,136 | A | | 4/1985 | Christine | |
| 4,566,250 | A | * | 1/1986 | Matsumura et al. | 53/133.2 |
| 4,568,321 | A | * | 2/1986 | Gaubert | 493/213 |
| 4,695,337 | A | * | 9/1987 | Christine | 493/213 |
| 4,710,157 | A | * | 12/1987 | Posey | 493/213 |
| 4,779,397 | A | * | 10/1988 | Christine et al. | 53/410 |
| 4,924,655 | A | * | 5/1990 | Posey | 53/133.2 |
| 5,203,819 | A | * | 4/1993 | Gleason | 53/133.2 |
| 5,493,845 | A | * | 2/1996 | Adolf et al. | 53/410 |
| 5,601,669 | A | * | 2/1997 | Moody et al. | 493/213 |

* cited by examiner

*Primary Examiner*—Stephen F. Gerrity
(74) *Attorney, Agent, or Firm*—Shoemaker and Mattare

(57) ABSTRACT

A web of film is folded lengthwise, and its superposed sections are joined together along transverse lines to form a series of pockets. A hole is then cut in each pocket near the fold line. The film is shaped and clamped between two curved shaping parts, and a blade in one of the parts is advanced toward a counter blade on the other part. A shoulder element having a pouring spout and a flange is introduced into the pocket and the spout is inserted through the hole, whereafter the flange is joined to the pocket.

7 Claims, 4 Drawing Sheets

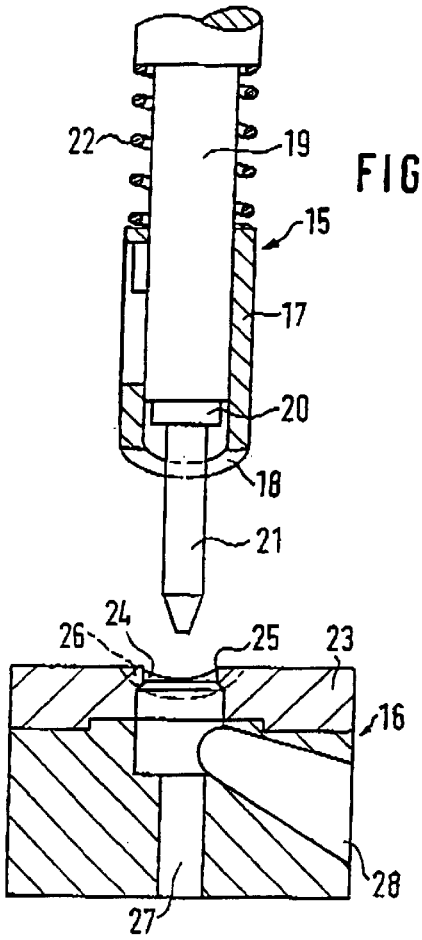
FIG.5
FIG.6
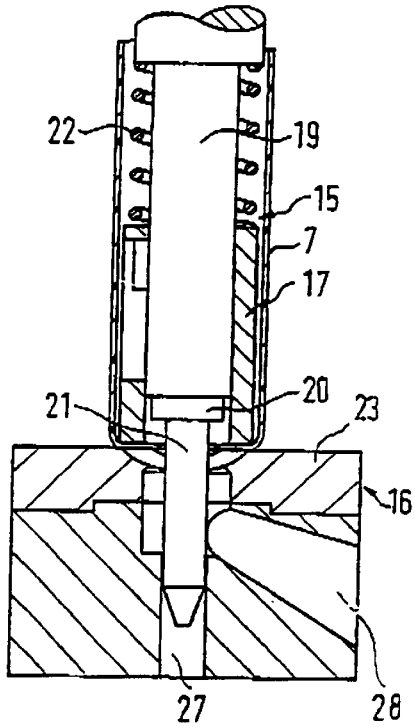
FIG.7
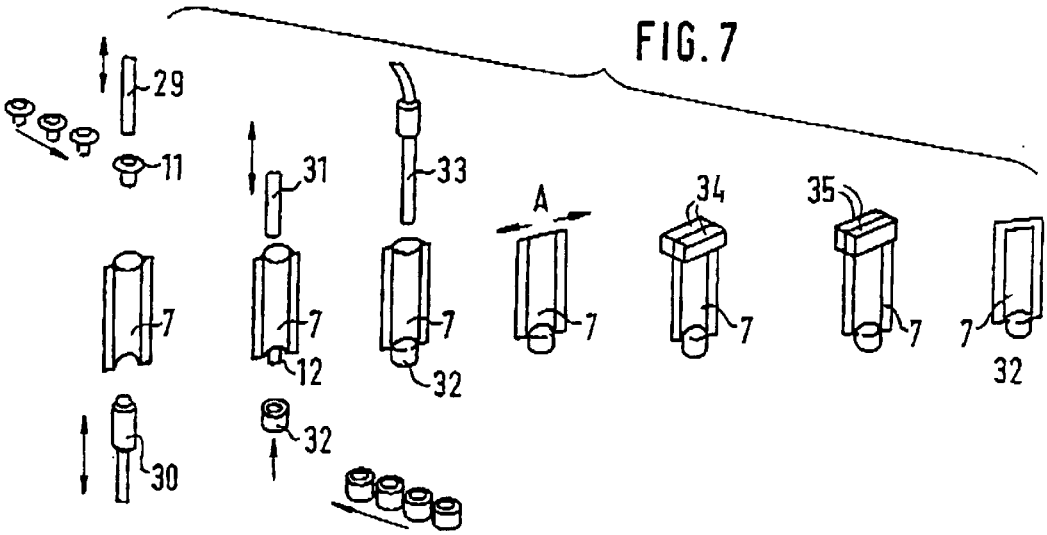

METHOD FOR ATTACHING A SHOULDER ELEMENT TO A BAG

CROSS REFERENCE TO RELATED APPLICATIONS

This application is a National Stage filing under 35 U.S.C. §371 of International Application No. PCT/CH99/00290, which has an international filing date of Jul. 2, 1999 and which designates the United States of America.

BACKGROUND

Known bag tubes have a film material of plastic which forms an end-face wall and two side walls of the tube, wherein the side walls are welded (or connected in another manner) to one another along two side sections, and a shoulder piece which comprises a closable outlet piece and a flange fastened on the end-face wall, preferably curved just as the end-face wall.

The invention relates to a method for manufacturing bag tubes, wherein a web of film material is folded about a fold line running in its longitudinal direction. The sections of the web are laid on one another, along strips which are arranged at distances from one another and which run transversely to the fold line, and are connected to one another in order to form a row of pockets. A hole is cut in each pocket in the region of the fold line and then a shoulder piece is introduced into each pocket. The shoulder piece comprises a closable outlet piece and a flange projecting from the piece. The outlet piece of the shoulder piece is inserted through the hole, the flange of the shoulder piece is connected to the film material, the outlet piece of the shoulder piece is closed, the pocket then from the open end is filled, and finally the open end is closed.

In known methods of this type it is difficult to cut a round hole precisely into the film material forming the end-face wall and to prevent a distortion of the film material which may lead to shoulder pieces seated too obliquely in the bag tubes.

SUMMARY OF THE INVENTION

The object of the invention lies in avoiding these difficulties, thus to permit a precise cutting of the hole and avoiding a distortion of the film material.

According to the invention this object is achieved in that, for cutting the hole into each pocket, the film material of the pocket in the region of the fold line is shaped and clamped between two shaping parts and then in one of the shaping parts a knife is displaced and moved to a counter knife on the other shaping part.

The applied shaping parts may usefully be curved, roughly about an axis perpendicular to the connection plane of the two strips limiting the pocket. In the same manner the flange of the shoulder piece to be inserted may also be curved.

The pocket may in the axial direction be relatively long. So that the two shaping parts, of which one must be introduced into the pocket, may cooperate precisely despite this, the knife and the other shaping part may usefully comprise a centering pin and a receiving bore.

BRIEF DESCRIPTION OF THE DRAWINGS

FIG. 5, on a larger scale, is an axial section through the two shaping parts at a distance to one another;

FIG. 6 is the same view as FIG. 5, showing the position in which the two shaping parts cooperate with one another;

FIG. 7 schematically represents further processing steps of a pocket after the processing by the shaping parts;

DESCRIPTION OF THE PREFERRED EMBODIMENTS

Figure 1:
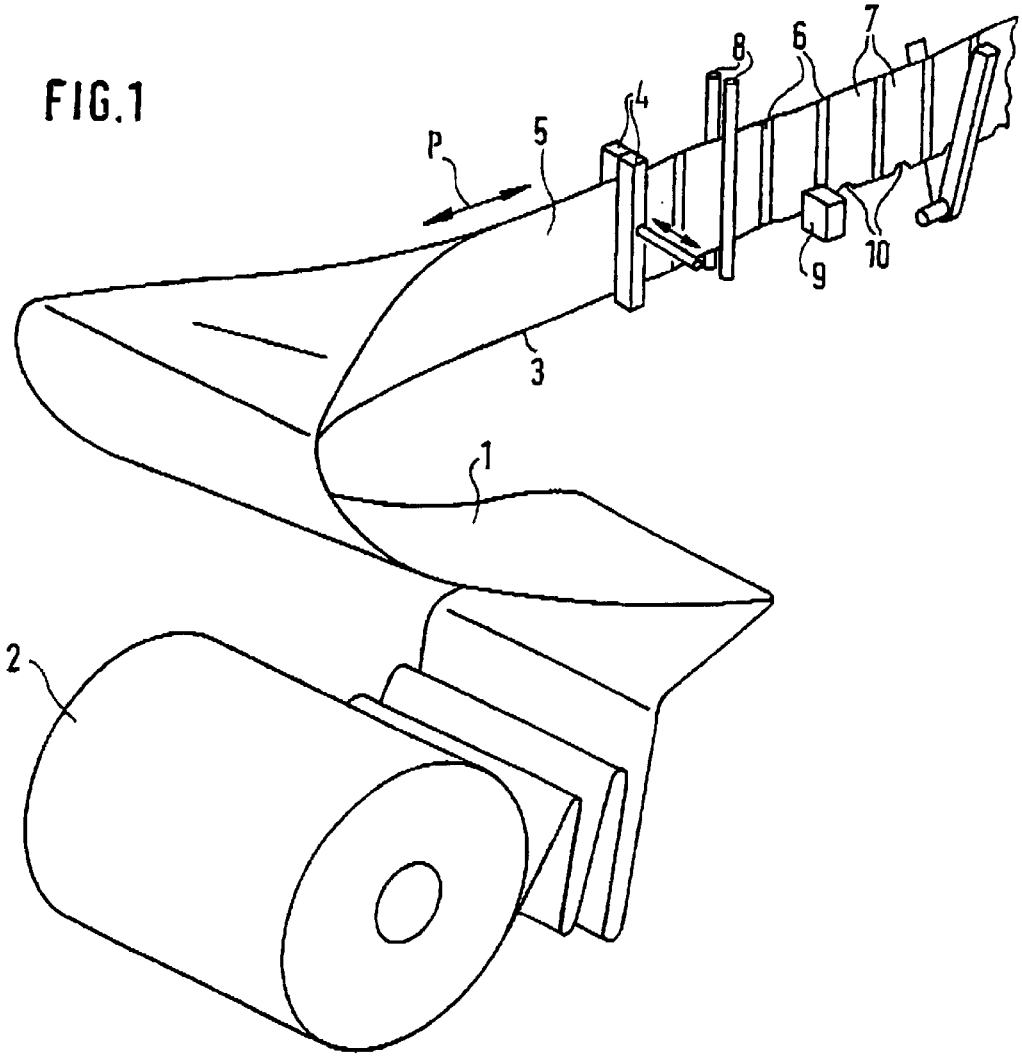
FIG. 1 is a schematic of a web of plastic film material, showing how it is initially folded and processed.

FIG. 1 shows a web 1 of plastic film material which is continuously unwound from a roller 2 and is folded about a fold line 3 running in its longitudinal middle line. The web is moved stepwise in the direction of the arrow P. At a first station, welding jaws are moved towards the folded film web 5 in order to connect to one another the two sections of the film web, which are laid on one another, along a strip running transversely to the fold line 3. The connection strips 6 which are formed after one another have, in the movement direction of the web 5, distances to one another so that the film material in each case between two strips 6 neighboring one another forms a pocket 7. There thus arises a row of pockets.

At a next station, cooling elements 8 act on the connection strips 6 in order to cool the film material heated by the welding process.

At a third station, where desired, punching tools 9 in the region of the fold line 3 punch a small section 10 out of the film material in order in the closed end of each pocket 7 to form a small prepunch.

Figure 2:
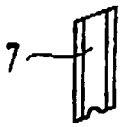
FIG. 2 shows an individual pocket formed of the film material.

At a fourth station, the pockets 7 are separated from one another by cutting through the strips 6 roughly in the middle. Thus individual pockets may arise. It is, however, also possible to form groups of two or more pockets. The pockets of each group may then, where desired, be processed together in the subsequent stations when the tools in these subsequent stations are present doubly or several times. FIG. 2 shows a single pocket 7 formed by the cutting.

The shoulder piece 11 is then inserted into the pocket 7. The shoulder piece 11 has an outlet piece 22 which is provided with a thread and is closable with a screw cap (not shown here), and a flange 13 which projects from the piece 12 and is curved in one direction (according to a cylinder surface).

Figure 4:
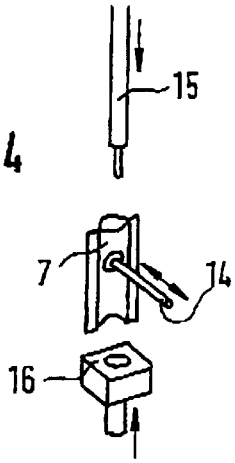
FIG. 4 is a schematic representation of the shaping parts used on cutting a hole into the pocket.

Before inserting the shoulder piece 11, as shown in FIG. 4, the pocket 7 is opened with suction cups 14 engaging its die walls. Then a first shaping part 15 is introduced through the open end of the pocket 7. A complementary second shaping part 16, lying opposite the first shaping part 15, is applied onto the film material of the pocket 7. The shaping parts 15 and 16 are shown at a larger scale in FIGS. 5 and 6.

Figure 3:
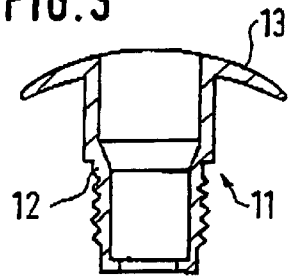
FIG. 3 shows, on a larger scale, an axial section through a shoulder piece to be applied into the pocket.

The first shaping part 15 has a sleeve whose working end 18 is curved just like the flange 13 of the shoulder piece 11 of FIG. 3. The axis of curvature (not illustrated) runs in FIGS. 5 and 6 in the plane of the drawing. The sleeve 17 is guided axially displaceable on a rod 19. The rod 13 carries at one end a circular knife 20. Furthermore, the rod 19 in the illustrated embodiment carries a centering pin 21 projecting out of the knife 20. Between the end of the sleeve 17, this end lying opposite the working end 18, and a shoulder on the rod 19 there is a compression spring 22.

The second shaping part 16 has a block 23 with a circular opening 24 whose edge 25 forms a counter knife for the knife 20. A surface section 26 of the block 23, surrounding the opening 24, is curved just like the working end 18 of the sleeve 17.

The first shaping part 15—as described previously with FIG. 4—is introduced into the open end of a pocket 7. The centering pin 21 of the first shaping part 15 penetrates through the prepunch which, at the third station in FIG. 1, has been formed by the punching tool 9 in the film material of the pocket 7. The diameter (or generally the transverse dimension) of the prepunch is preferably somewhat larger than the diameter of the centering pin 21. If there is no such prepunch, a pointed centering pin 21 may be used which may simply penetrate through the film material.

The second shaping part 16, lying opposite the first shaping part 15, is applied onto the film material of the pocket 7. The centering pine 21 of the first shaping part 15 is accommodated in a receiving bore 27 in the second shaping part 16, by which means the two shaping parts 15 and 16 are aligned exactly with one another. The end-face wall of the pocket 7 which has arisen with the opening of the pocket, as shown in FIG. 6, is clamped and shaped between the curved working end 18 of the sleeve 17 and the equally curved surface section 26 of the block 23. The sleeve 17 and/or the block 23 when desired may be heated for this. The end-face wall of the pocket thus obtains the same curvature as the flange 13 of the should piece of FIG. 3.

Upon moving the rod 15 towards the block 23 and compressing the spring 22, the knife 20 is moved to the counter knife 25 on the block 23 and the shaped and clamped film material of the end-face wall of the pocket is cut through. The cut-out film ring may be suctioned away in the second shaping part through a suction bore 28.

As shown in FIG. 7, a tool 29 then introduces a shoulder piece 11 into the pocket 7 with the precisely cut-out hole in the end-face wall, at a first station. The end-face wall of the pocket is at the same time supported by a counter tool 30. The outlet piece 12 (FIG. 3) of the shoulder piece 11 enters through the hole in the end-face wall of the pocket. The flange 13 (FIG. 3) of the shoulder piece 11 is fastened on the end-face wall of the pocket, for example by adhesion or welding. The two tools 29 and 30 may simultaneously be designed as welding heads for welding the flange 13 to the end-face wall of the pocket, fox example by ultrasound.

In a next station in FIG. 7, a tool 31 for supporting the shoulder piece, fastened on the end-face wall of the pocket, is introduced into the pocket, and a closure cap 32 is screwed or pressed onto the outlet piece 12. While the closure cap 32 is screwed on, the tool 31 simultaneously serves as a rotational securement for preventing a co-rotation of the shoulder piece and as the end-face wall of the pocket.

In a subsequent station, the pocket 7, closed with the closure cap 32, is filled from a filling tube 33.

Then in a further station, the open end of the pocket is pulled tight in the direction of the arrows A, and in a subsequent station the edge sections of the two side walls of the pocket in the region of the end of the pocket, this end until now being open, are welded to one another by welding tools 34. The edge sections welded to one another may then be cooled by cooling elements 35. The finished bag tube 7, which is closed with the closure cap 32, is filled and is sealed all around the edges of the side walls, as represented in FIG. 7 on the far right.

In the embodiment described above, the outlet piece 1 (FIG. 3) has an outer thread onto which then the closure cap 32 (FIG. 7) is screwed in order to close the outlet piece 12. Alternatively, a shoulder piece 41 according to FIG. 8 may be used. This has an outlet piece 42 and a flange 43 projecting from the outlet piece. The outlet piece 42 comprises latching means for holding firm a coupling sleeve 44 (FIG. 9) which may be pressed onto the outlet piece and which comprises an outer thread 45. In FIG. 10, the coupling sleeve 44 is pressed onto the outlet piece and is shown with a screwed-on closure cap 46. The screwing (or the pressing) of the closure cap 46 onto the coupling sleeve 44 may be effected before or after the pressing of the coupling sleeve onto the outlet piece 42.

Figure 8:
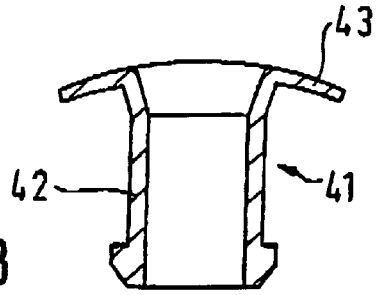
FIG. 8 is an axial section through a shoulder piece in a modified embodiment.
Figure 9:
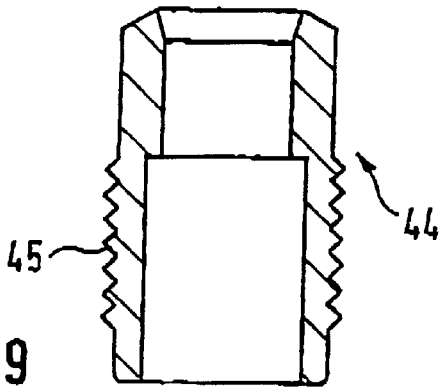
FIG. 9 is an axial section through a coupling sleeve to be connected to the shoulder piece of FIG. 8.
Figure 10:
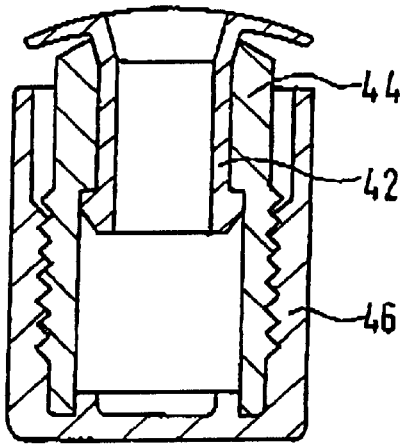
FIG. 10 show the shoulder piece of FIG. 8 and the coupling sleeve of FIG. 9 constructed together and with a screwed-on closure cap.

A shoulder piece with a coupling sleeve of the type shown in FIGS. 8 to 10 may alternatively be designed such that the edge of the hole in the end-face of the pocket, though which hole the shoulder piece is inserted, may be clamped between the flange of the shoulder piece and the coupling sleeve. Two such variants are shown in FIGS. 11 and 12, at a larger scale.

Figure 11:
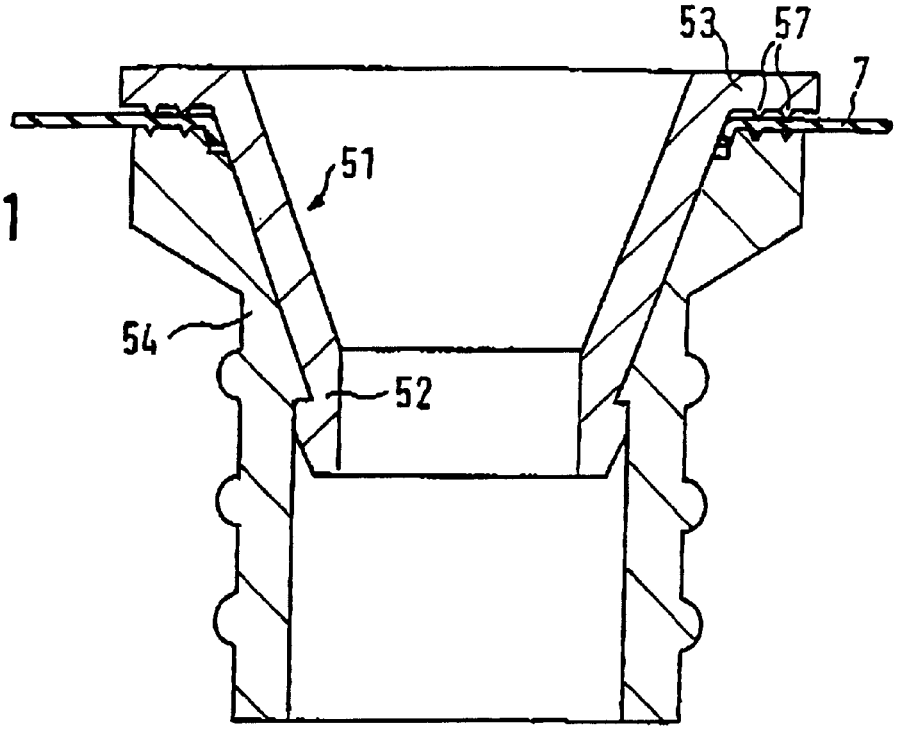
FIG. 11 is an axial section through one variant of the shoulder piece of FIG. 8 and of the coupling sleeve of FIG. 9.

FIG. 11 shows how an edge of the film material of a pocket is clamped between a flange 53 of a shoulder piece 52 and the end of a coupling sleeve 54. The coupling sleeve 54, as described by FIGS. 8 to 10, is pressed onto an outlet piece 52 of the shoulder piece 51. Owing to the clamping of the film material, the welding or adhesion of the film material to the flange 53 may be done away with. For improving the sealing between the film material and the flange 53, the flange may have circular ribs 57 which press the film material into corresponding grooves in the end surface of the coupling sleeve.

Figure 12:
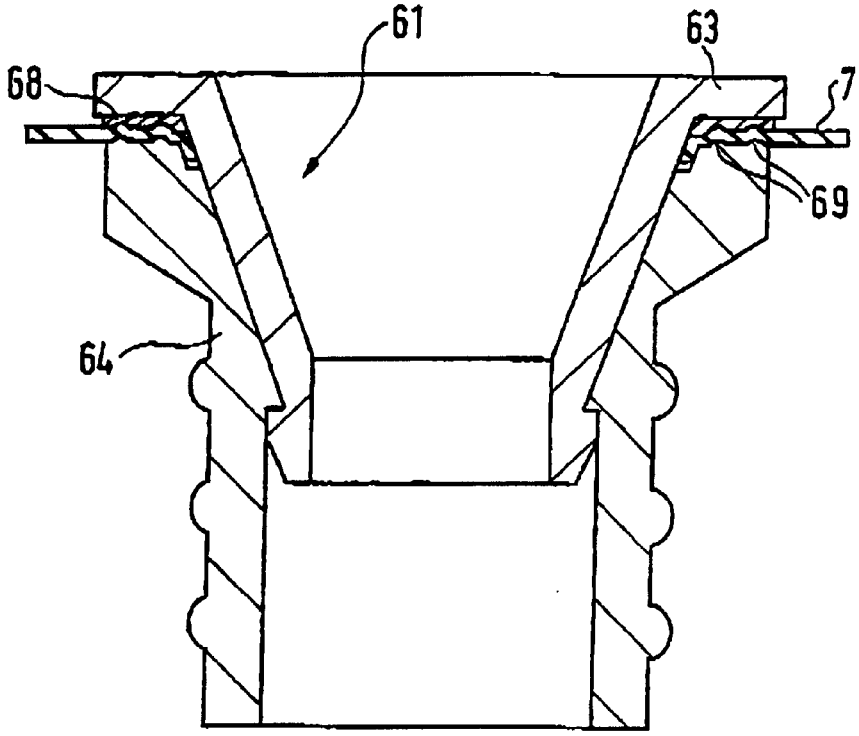
FIG. 12 is an axial section through another variant of the shoulder piece of FIG. 8 and of the coupling sleeve of FIG. 9.

FIG. 12 shows, similarly to FIG. 11, a shoulder piece 61 with a flange 63, and a coupling sleeve 64, wherein the edge of the film material of a pocket 7 is clamped between the flange 63 and the end surface of the coupling sleeve 64. Between the flange 63 and the film material there is a suitable sealing medium 68, e.g., a latex. In this case the end surface of the coupling sleeve 64 may have circular ribs 69 which press the film material into the layer 68 of the sealing medium. In place of the layer of sealing medium 68, or in addition, a sealing medium layer may also be arranged between the film material and the end surface of the coupling sleeve 64. With such a sealing medium layer, gases or vapors from the contents of the bag tube may be prevented, between the outlet piece of the shoulder piece and the coupling sleeve, from reaching the film material and then, between this and the end surface of the coupling sleeve, from reaching the outside.

What is claimed is:

1. A method for manufacturing bag tubes, said method comprising the steps of:

folding a web of film material about a longitudinal fold line, laying sections of the web on one another, along strips which are arranged as a distance from one another, and which run transversely to the fold line, connecting the sections to one another in order to form a row of pockets, cutting a hole in each pocket in the region of the fold line, then introducing into each pocket a shoulder piece comprising a closable outlet piece and a flange projecting from the outlet piece, by inserting the outlet piece of the shoulder piece through the hole, connecting the shoulder piece to the film material, closing the outlet piece of the shoulder piece, then filling the pocket from the open end and closing the open end, wherein for cutting the hole into each pocket, the film material of the pocket in the region of the fold line is shaped and clamped between two shaping parts and then in one of the shaping parts a knife is displaced and moved to a counter knife on the other shaping part.

2. A method according to claim 1, wherein the applied shaping parts are curved, essentially about an axis perpendicular to the connection plane of the two strips limiting the pocket.

3. A method according to claim 1, wherein the knife and the other shaping part comprise a centering pin and a bore for receiving the pin.

4. A method according to claim 3, further comprising a step of punching a cut-out into the fold line of the sections of the web which are laid on one another, in order to form a prepunch for the subsequent penetration of the centering pin.

5. A method according to claim 4, wherein the prepunch has a diameter somewhat larger than the diameter of the centering pin.

6. A method according to claim 1, wherein at least one of the shaping parts is heated.

7. A method according to claim 1, further comprising a step of suctioning away the cut-out film material through a suction bore in one of the shaping parts.

* * * * *